US006990304B2

(12) United States Patent
Mitamura et al.

(10) Patent No.: US 6,990,304 B2
(45) Date of Patent: Jan. 24, 2006

(54) IMAGE FORMING APPARATUS AND DRIVING DEVICE FOR IMAGE CARRYING MEMBER WITH BANDING SUPPRESSION

(75) Inventors: Yoshihiko Mitamura, Ebina (JP); Susumu Kibayashi, Ebina (JP); Norio Hokari, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 145 days.

(21) Appl. No.: 10/681,120

(22) Filed: Oct. 9, 2003

(65) Prior Publication Data

US 2004/0184845 A1 Sep. 23, 2004

(30) Foreign Application Priority Data

Mar. 20, 2003 (JP) ..... 2003-078954

(51) Int. Cl.
*G03G 15/00* (2006.01)
*G03G 15/01* (2006.01)

(52) U.S. Cl. ..... 399/167; 399/302; 399/303

(58) Field of Classification Search ..... 399/162, 399/163, 167, 302, 303
See application file for complete search history.

(56) References Cited

U.S. PATENT DOCUMENTS 5,421,255 A * 6/1995 Kryk ..... 399/162
5,528,348 A * 6/1996 Miwa et al. ..... 399/167
5,778,287 A * 7/1998 Yu ..... 399/167

FOREIGN PATENT DOCUMENTS

JP 7-140842 6/1995
JP 9-292778 11/1997

* cited by examiner

*Primary Examiner*—William J. Royer
(74) *Attorney, Agent, or Firm*—Morgan Lewis & Bockius LLP

(57) ABSTRACT

A driving device for an image carrying member, e.g., a belt, is to be provided that causes no increase in size and cost of the device and sufficiently stabilizes the velocity of the image carrying member upon fluctuation in load, so as to suppress or prevent formation of an image defect referred to as so-called "banding". A rotating member is made in contact with at least one of a driving force transmitting member and an image carrying member, which are arranged in a driving force transmission path for transmitting the driving force to the image carrying member, and the rotating member rotates in contact with the driving force transmitting member or the image carrying member, and providing, upon occurring fluctuation in velocity of the driving force transmitting member or the image carrying member, a viscous effect that suppresses the fluctuation in velocity.

19 Claims, 12 Drawing Sheets

FIG. 11

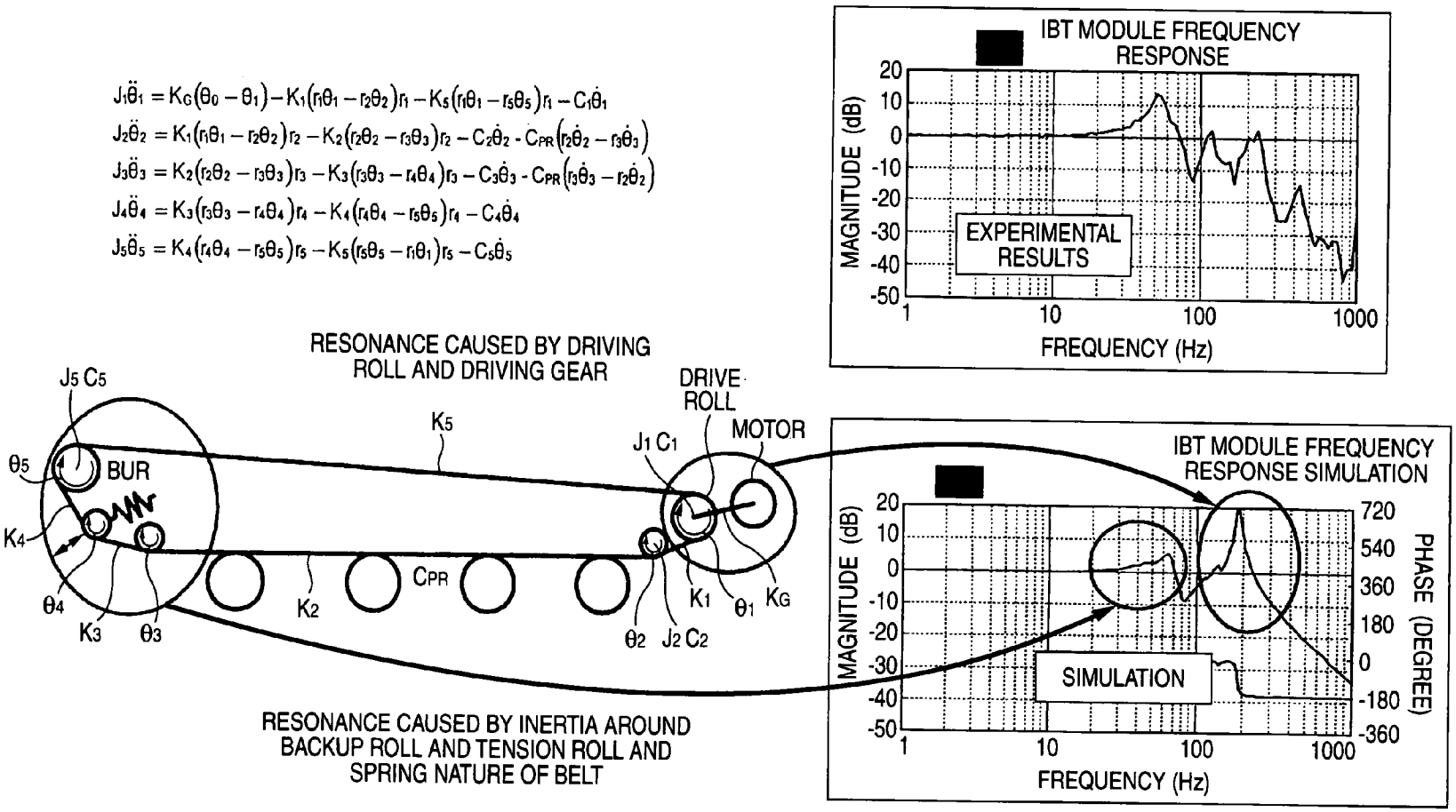

$$J_1\ddot{\theta}_1 = K_G(\theta_0 - \theta_1) - K_1(r_1\theta_1 - r_2\theta_2)r_1 - K_5(r_1\theta_1 - r_5\theta_5)r_1 - C_1\dot{\theta}_1$$

$$J_2\ddot{\theta}_2 = K_1(r_1\theta_1 - r_2\theta_2)r_2 - K_2(r_2\theta_2 - r_3\theta_3)r_2 - C_2\dot{\theta}_2 - C_{PR}(r_2\dot{\theta}_2 - r_3\dot{\theta}_3)$$

$$J_3\ddot{\theta}_3 = K_2(r_2\theta_2 - r_3\theta_3)r_3 - K_3(r_3\theta_3 - r_4\theta_4)r_3 - C_3\dot{\theta}_3 - C_{PR}(r_3\dot{\theta}_3 - r_2\dot{\theta}_2)$$

$$J_4\ddot{\theta}_4 = K_3(r_3\theta_3 - r_4\theta_4)r_4 - K_4(r_4\theta_4 - r_5\theta_5)r_4 - C_4\dot{\theta}_4$$

$$J_5\ddot{\theta}_5 = K_4(r_4\theta_4 - r_5\theta_5)r_5 - K_5(r_5\theta_5 - r_1\theta_1)r_5 - C_5\dot{\theta}_5$$

IMAGE FORMING APPARATUS AND DRIVING DEVICE FOR IMAGE CARRYING MEMBER WITH BANDING SUPPRESSION

BACKGROUND OF THE INVENTION

1. Field of the Invention

The present invention relates to an image forming apparatus and a driving device used in an image forming apparatus.

2. Description of the Related Art

According to the conventional techniques, a color image forming apparatus, such as a color duplicator, a color printer and a color facsimile adapting this electrophotographic system, is constituted, for example, in the manner shown in FIG. 17. That is, plural photoreceptor drums 101Y, 101M, 101C and 101K for forming toner images of yellow, magenta, cyan and black are arranged along a lower surface (or an upper surface) of an endless intermediate transfer belt 100, and charging units, exposing units, developing units and the like, which are not shown in the figure, are arranged around the respective photoreceptor drums 101Y, 101M, 101C and 101K. The toner images of yellow, magenta, cyan and black formed on the photoreceptor drums 101Y, 101M, 101C and 101K are sequentially transferred on the intermediate transfer belt 100 by overlapping each other, and the toner images of yellow, magenta, cyan and black thus transferred by overlapping on the intermediate transfer belt 100 are finally transferred at a time to recording paper to form a color image. The intermediate transfer belt 100 herein is, for example, stretched on plural rolls including a driving roll 102 for driving the intermediate transfer belt 100, a pair of primary transfer surfacing rolls 103 and 104 arranged horizontally, a tension roll 105 for applying a tension on the intermediate transfer belt 100, and a backup roll 106 in contact with a secondary transfer roll through the intermediate transfer belt 100. The driving roll 102 is constituted as being rotationally driven by a driving motor (not shown in the figure) provided on the side of the main body of the apparatus through a gear train (not shown in the figure) constituted with plural gears.

In the aforementioned color image forming apparatus using the tandem intermediate transfer system, it has been known that in the case where fluctuation occurs in the driving velocity of the intermediate transfer belt 100, an image defect referred to as so-called "banding" occurs, in which the image density of the zonal regions along the direction perpendicular to the driving direction of the intermediate transfer belt 100 is periodically fluctuated along the moving direction of the intermediate transfer belt 100.

Therefore, in order to prevent the image defect referred to as so-called "banding" and to obtain a printed image with good image quality in the aforementioned color image forming apparatus, it is necessary that the intermediate transfer belt 100 is driven at a stable velocity with high accuracy, whereby the moving velocity of the intermediate transfer belt 100 is stabilized.

With respect to a driving device for driving an image carrying member containing the intermediate transfer belt 100 (and also a photoreceptor drum), JP-A-9-292778 and JP-A-7-140842 have proposed techniques for stabilizing the moving velocity of the belt and the like.

In an image transferring apparatus described in JP-A-9-292778, in order to improve the transfer function characteristics of the driving system for driving an endless transfer belt, a flywheel is attached to at least one of pivots of a driving roll and a driven roll through a torsional elastic body.

In a driving device for a rotation body described in JP-A-7-140842, a rotation body and a driving gear are connected with an elastic member or a viscoelastic body.

However, the aforementioned conventional techniques contain the following problems. In the case of the image transferring apparatus described in JP-A-9-292778, a flywheel is attached to at least one of pivots of a driving roll and a driven roll through a torsional elastic body, and therefore, it has such a problem in that the apparatus unavoidably becomes large sized and suffers increase in cost due to the flywheel attached.

In the case of the driving device for a rotation body described in JP-A-7-140842, a rotation body and a driving gear are connected with an elastic member or a viscoelastic member, and therefore, it has such a problem in that the velocity of the rotation body, such as a belt, cannot be sufficiently stabilized upon fluctuating in load due to influence on elastic deformation of the elastic body or the viscoelastic body.

Furthermore, there is a common problem in the techniques described in JP-A-9-292778 and JP-A-7-140842. That is, the attachment of a flywheel to the pivot of a driving roll or the like through a torsional elastic body and the connection of a rotation body and a driving gear with an elastic member or a viscoelastic member can deviate the resonance point in the driving system of the driving roll to improve the transfer function characteristics. However, with respect to a resonance point ascribed to torsional rigidity of a belt and a driven roll stretching the belt, i.e., in the case where a resonance point outside the driving system comes into an issue, the techniques do not directly act on the belt, and therefore, sufficient effect is difficult to be obtained for stabilizing the velocity of the belt. The resonance point outside the driving system is often present in a frequency range of from several tens to 100 Hz, and causes such severe problems in that it is liable to agree with the engaging frequency of the gear driving system, and the banding occurs in this frequency range, which is liable to be recognized as a defect in image quality due to the characteristics of human vision.

More specifically, FIG. 18 shows measurement results of fluctuation in rotation of the driving roll 102 driving the intermediate transfer belt 100 in the aforementioned color image forming apparatus in such a state that no improving technique is employed, i.e., the attachment of a flywheel to the driving roll 102 and the connection of the driving roll 102 and the driving gear with an elastic member or a viscoelastic member are not employed. The ordinate in FIG. 18 indicates the value obtained by FFT analysis of fluctuation in rotation velocity of the driving roll 102. FIG. 19 shows the transfer function characteristics of the driving system from the driving motor to the driving roll 102. The ordinate in FIG. 19 indicates the value showing a magnitude of the transfer function. The two significant peaks occurring in FIG. 18 are a peak at 34.5 Hz corresponding to the engaging frequency of the gears for rotationally driving the driving roll 102 and a peak at 69.0 Hz corresponding to the secondary harmonic wave of the engaging frequency of the gears for rotationally driving the driving roll 102.

It is understood from FIG. 19 that the transfer function has a resonance point with a peak around 50 Hz and a magnifying area in a range of from 20 to 70 Hz, so as to cause the peak in velocity fluctuation at 34.5 Hz in FIG. 18. Furthermore, as a result of analysis of the characteristic value of the stretching and driving system for stretching and driving the intermediate transfer belt 100, it has been found that, as shown in FIG. 19, the resonance point with a peak around 50

Hz is caused by the inertia and the torsional rigidity of the backup roll 106, the tension roll 105 and the primary transfer surfacing roll 104, which are arranged on the left side of the belt stretching and driving system, and the spring constant of the intermediate transfer belt 100 itself. In other words, in the stretching and driving system for stretching and driving the intermediate transfer belt 100, the backup roll 106, the tension roll 105 and the primary transfer surfacing roll 104, which are arranged on the left side of the belt stretching and driving system, function as an inertial mass as viewed from the driving roll 102 for driving the intermediate transfer belt 100, and the backup roll 106, the tension roll 105 and the primary transfer surfacing roll 104 have torsional rigidity. Furthermore, the backup roll 106, the tension roll 105 and the primary transfer surfacing roll 104 are connected to the driving roll 102 mainly through the belt functioning as an elastic body to constitute the stretching and driving system. Therefore, it is considered that the resonance point of the intermediate transfer belt 100 itself and the stretching and driving system constituted with the backup roll 106, the tension roll 105 and the primary transfer surfacing roll 104 appears as a large peak in the magnifying area in the transfer function characteristics, which becomes the principal factor of the fluctuation in velocity of the intermediate transfer belt 100.

On the other hand, the resonance point ascribed to the torsional rigidity of the driving system from the driving motor to the driving roll 102 is present around 200 Hz, and it is understood that it corresponds to the peak around 200 Hz in FIG. 19. That is, in order to stabilize the driving velocity of the belt, the attachment of a flywheel to the driving system of the driving roll and the connection of the driving roll 102 and the driving gear with an elastic member can reduce or move higher or lower the resonance point around 200 Hz ascribed to the torsional rigidity of the driving system for driving the driving roll 102, but cannot change the resonance point around 50 Hz ascribed to the inertia and the torsional rigidity of the belt stretching and driving system and the spring constant of the belt itself. As a result, no sufficient effect is obtained in stabilizing the velocity of the belt, and such a problem remains in that banding that is liable to be recognized as a defect in image quality cannot be effectively prevented.

SUMMARY OF THE INVENTION

The invention is to solve the aforementioned problems associated with the conventional techniques and to provide such a driving device for an image carrying member, e.g., a belt, that causes no increase in size and cost of the device and sufficiently stabilizes the velocity of the image carrying member such as a belt, upon fluctuation in load, so as to suppress or prevent formation of an image defect referred to as so-called "banding".

The driving device for an image carrying member for rotationally driving the image carrying member by transmitting a rotational driving force to the image carrying member according to the invention contains, in one aspect, a rotating member rotating in contact with at least one of a driving force transmitting member and the image carrying member, which are arranged in a driving force transmission path for transmitting the driving force to the image carrying member, the rotating member rotating in contact with the driving force transmitting member or the image carrying member, and providing, upon occurring fluctuation in velocity of the driving force transmitting member or the image carrying member, a viscous effect that suppresses the fluctuation in velocity.

BRIEF DESCRIPTION OF THE DRAWINGS

Preferred embodiments of the present invention will be described in detail based on the following figures, wherein:

FIG. 11 is a graph showing experimental results and simulation results;

DESCRIPTION OF PREFERRED EMBODIMENTS

Embodiments of the invention will be described below with reference to the drawings.

Embodiment 1

Figure 2:
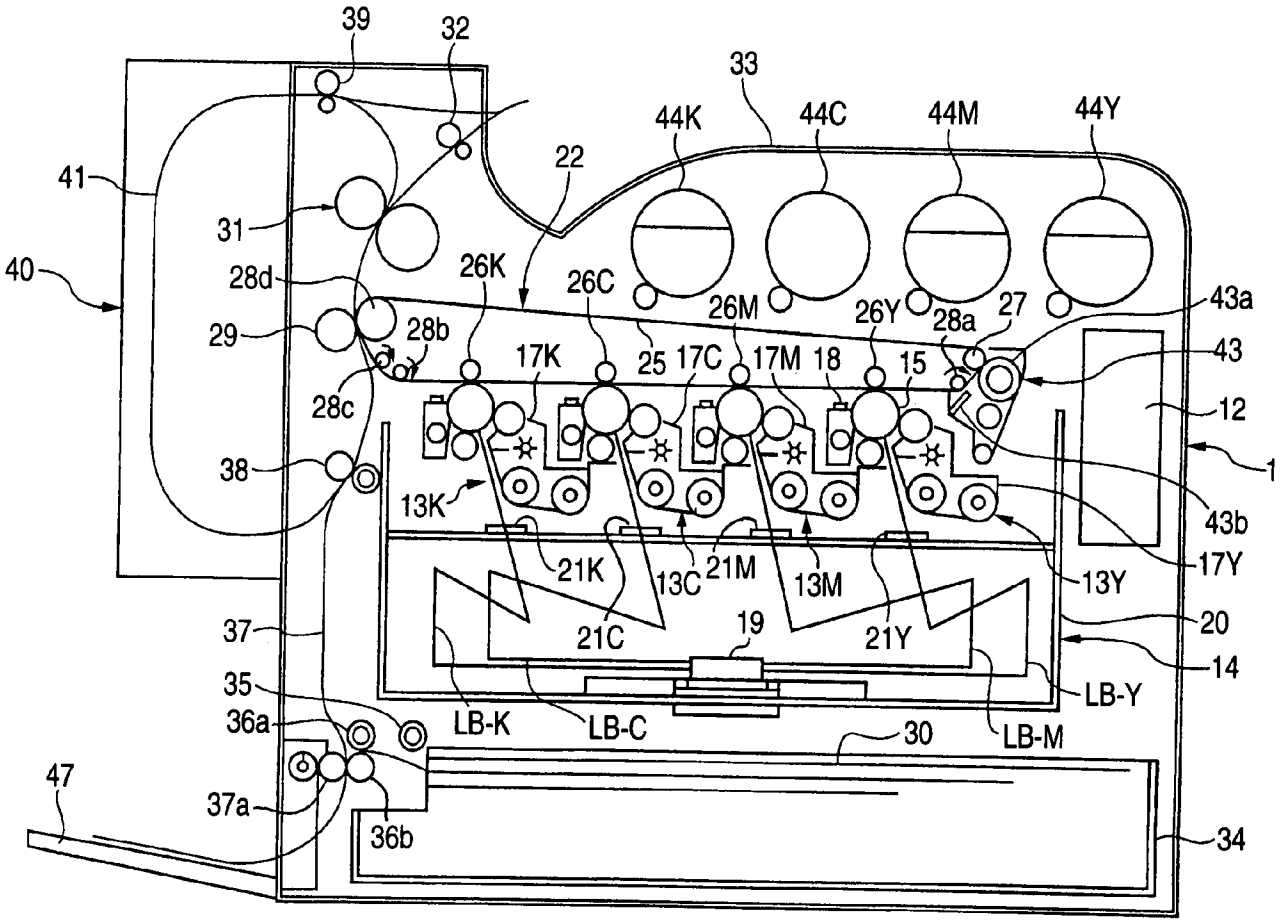
FIG. 2 is a constitutional view showing a digital printer as an image forming apparatus, to which a driving device for an image carrying member according to Embodiment 1 of the invention is applied.
Figure 3:
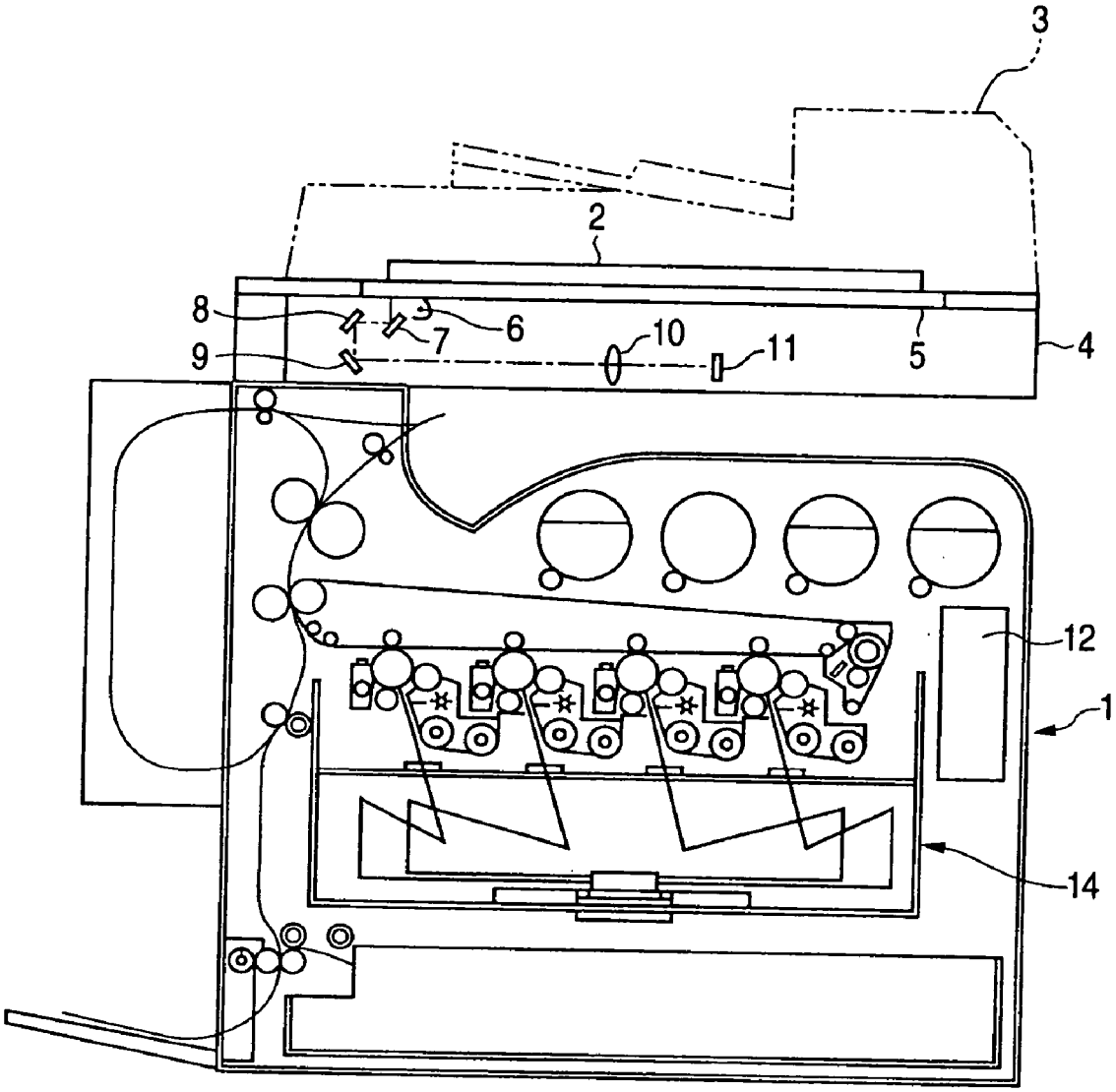
FIG. 3 is a constitutional view showing a digital duplicator as an image forming apparatus, to which a driving device for an image carrying member according to Embodiment 1 of the invention is applied.

FIG. 2 shows a tandem digital color printer as an image forming apparatus, to which a driving device for an image carrying member according to Embodiment 1 of the invention is applied. FIG. 3 shows a tandem digital color duplicator as an image forming apparatus, to which a paper feeding device according to the Embodiment 1 of the invention is applied.

In FIGS. 2 and 3, numeral 1 denotes a main body of a tandem digital color printer or duplicator, and in the case of the digital color duplicator, an automatic document feeder (ADF) 3 for automatically feeding a document 2 in the form of a sole sheet separated from another, and a document reading device 4 for reading an image of the document 2 fed by the automatic document feeder 3 are arranged in an upper part of the main body 1 as shown in FIG. 3. In the document reading device 4, the document 2 placed on a platen glass 5 is illuminated with a light source 6, and an image reading element 11, such as a CCD, is scan-exposed with a reflected light image from the document 2 through a reducing optical system containing a full rate mirror 7, half rate mirrors 8 and 9 and an imaging lens 10, whereby the reflected light image of color materials of the document 2 is read by the image reading element 11 at a prescribed dot density (for example, 16 dot/mm).

The reflected light image of color materials of the document 2 thus read by the document reading device 4 is sent to an image processing system (IPS) 12, for example, as document reflectivity data of three colors, red (R), green (G) and blue (B), in 8 bits per one color, and the IPS 12 applies prescribed image processing, such as shading compensation, displacement compensation, brightness/color space conversion, gamma compensation, erasure of frames and edit of color and displacement, to the reflectivity data of the document 2. The IPS 12 also applies the similar image processing to an image data sent from a personal computer.

The image data thus applied with the prescribed image processing in the IPS 12 is converted to color material gradation data for reproducing the document of four colors, yellow (Y), magenta (M), cyan (C) and black (K), in 8 bits per one color, which are then sent to raster output scanners (ROS) 14 of image forming units 13Y, 13M, 13C and 13K of the respective colors, yellow (Y), magenta (M), cyan (C) and black (K). In the ROS 14 as an image exposing device, image exposure is carried out with laser beams LB (LB-Y, LB-M, LB-C and LB-K) corresponding to the color material gradation data for reproducing the document of the prescribed colors.

As shown in FIGS. 2 and 3, four image forming units 13Y, 13M, 13C and 13K of yellow (Y), magenta (M), cyan (C) and black (K) are horizontally arranged in parallel with a constant interval inside the main body 1 of the tandem digital color printer or duplicator.

The four image forming units 13Y, 13M, 13C and 13K have the same constitution, which is schematically constituted with a photoreceptor drum 15 as an image carrying member being rotationally driven at a prescribed velocity, a charging roll 16 for primary charge for uniformly charging the surface of the photoreceptor drum 15, the ROS 14 as an image exposing device for exposing the surface of the photoreceptor drum 15 with an image corresponding to the prescribed color to form an electrostatic latent image, a developing device 17 for developing the electrostatic latent image thus formed on the photoreceptor drum 15 with a toner of the prescribed color, and a cleaning device 18 for cleaning the surface of the photoreceptor drum 15. The photoreceptor drum 15 and the image forming members arranged there around are unitized and can be individually replaced within the main body 1 of the printer or duplicator.

The ROS 14 has the same constitution as in the four image forming units 13Y, 13M, 13C and 13K as shown in FIGS. 2 and 3, and modulates four semiconductor lasers, which are not shown in the figures, corresponding to the color material gradation data for reproducing the document to emit laser beams LB-Y, LB-M, LB-C and LB-K corresponding to the gradation data from the semiconductor lasers. The ROS 14 may also be constituted individually for the plural image forming units, respectively. The laser beams LB-Y, LB-M, LB-C and LB-K thus emitted from the semiconductor lasers are incident on a polygonal mirror 19 through an f-θ lens, which is not shown in the figures, and subjected to polarization scanning by the polygonal mirror 19. The laser beams LB-Y, LB-M, LB-C and LB-K thus subjected to polarization scanning by the polygonal mirror 19 are subjected to scanning exposure of an exposure point on the photoreceptor drum 15 from a diagonally lower side through an imaging lens and plural mirrors, which are not shown in the figures.

The ROS 14 is to carry out scanning exposure of an image on the photoreceptor drum 15 from the lower side as shown in FIG. 2, and therefore, there is such a possibility that it is contaminated by a toner or the like dropping from the developing device 17 having the four image forming units 13Y, 13M, 13C and 13K. Accordingly, the periphery of the ROS 14 is sealed with a rectangular frame 20, and transparent glass windows 21 (21Y, 21M, 21C and 21K) are provided as a shielding member in an upper part of the frame 20 to expose the photoreceptor drums 15 of the image forming units 13Y, 13M, 13C and 13K with the four laser beams LB-Y, LB-M, LB-C and LB-K.

The image data of the respective colors are sequentially output from the IPS 12 to the ROS 14, which is commonly provided for the image forming units 13Y, 13M, 13C and 13K of the respective colors, yellow (Y), magenta (M), cyan (C) and black (K), and the laser beams LB-Y, LB-M, LB-C and LB-K emitted from the ROS 14 corresponding to the image data are subjected to scanning exposure of the surfaces of the photoreceptor drums 15 corresponding thereto, respectively, to form electrostatic latent images. The electrostatic latent images thus formed on the photoreceptor drums 15 are developed to toner images of the respective colors, yellow (Y), magenta (M), cyan (C) and black (K), by developing devices 17Y, 17M, 17C and 17K.

The toner images of the respective colors, yellow (Y), magenta (M), cyan (C) and black (K), having been sequentially formed on the photoreceptor drums 15 of the image forming units 13Y, 13M, 13C and 13K of the respective colors are transferred by overlapping each other to an intermediate transfer belt (image carrying member) 25 as an endless belt member arranged over the image forming units 13Y, 13M, 13C and 13K with four primary transfer rolls 26Y, 26M, 26C and 26K. The primary transfer rolls 26 (26Y, 26M, 26C and 26K) are arranged on the back surface side of the intermediate transfer belt 25 corresponding to the photoreceptor drums 15 of the image forming units 13Y, 13M, 13C and 13K, respectively. The primary transfer rolls 26Y, 26M, 26C and 26K used in this embodiment have been adjusted in volume resistivity to a range of from $10^5$ to $10^8$ Ωcm. The primary transfer rolls 26Y, 26M, 26C and 26K are connected to transfer bias electric power sources, which are not shown in the figures, whereby transfer bias having a polarity (positive polarity in this embodiment) opposite to that of the toner is applied at prescribed timing.

As shown in FIG. 2, the intermediate transfer belt 25 is stretched among rolls of the belt unit 22, i.e., a driving roll 27, a pair of primary transfer surfacing rolls 28*a* and 28*b* arranged horizontally, a tension roll 28*c* applying tension to the intermediate transfer belt 25 at a constant tension, and a backup roll 28*d* in contact with a secondary transfer roll 29 through the intermediate transfer belt 25, and is cyclically driven at a prescribed velocity in the direction shown by the arrows with the driving roll 27, which is rotationally driven by a driving motor (driving power source) excellent in constant speed property specialized therefor. The intermediate transfer belt 25 may be cyclically driven at the same velocity as the peripheral velocity of the photoreceptor drum 15, but in order to improve the transfer efficiency of the toner image from the photoreceptor drum 15 to the intermediate transfer belt 25, a prescribed difference in peripheral velocity of about 3% may be provided between the photoreceptor drum 15 and the intermediate transfer belt 25 (the velocity of the intermediate transfer belt 25 is larger). The intermediate transfer belt 25 is formed, for example, with a belt material that causes no charging up (rubber or resins), and the volume resistivity thereof may be adjusted to a range of about from $10^5$ to $10^{12}$ Ωcm.

Figure 5:
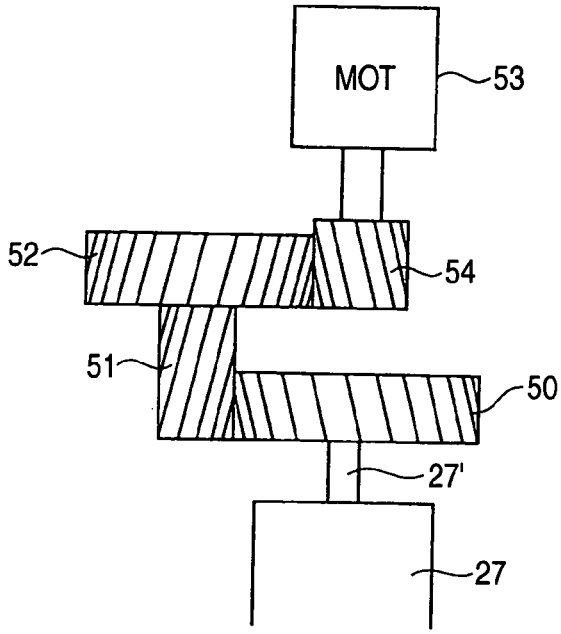
FIG. 5 is a constitutional view showing a driving system for a driving roll.

As shown in FIG. 5, a driven gear 50 is attached to a pivot 27' of the driven roll 27, and the driving gear 50 is engaged with a small idler gear 51 among reduction idler gears. A large idler gear 52 among the reduction idler gears is engaged with a driving gear 54 attached to a driving motor 53 as a driving power source containing a stepping motor, a DC induction motor or the like. The driving roll 27 is rotationally driven at a prescribed velocity by rotationally driving the driving motor 53 through the driving gear 54, the idler gears 52 and 51, and the driven gear 50.

As shown in FIG. 2, the toner images of the respective colors of yellow (Y), magenta (M), cyan (C) and black (K) having been transferred by overlapping each other on the intermediate transfer belt 25 are secondarily transferred to recording paper 30 as a recording medium with pressure and an electric field by the secondary transfer roll 29 in contact with the backup roll 28*d* under pressure, and the recording paper 30 having the toner images of the respective color having been transferred thereto is conveyed to a fusing device 31 arranged up over. The secondary transfer roll 29 is in contact with the side of the backup roll 28*d* under pressure, whereby it secondarily transfers the toner images of the respective colors to the recording paper 30 conveyed from the bottom up. The recording paper 30 having the toner images of the respective colors transferred thereto is subjected to a fusing treatment with heat and pressure in the fusing device 31 and then exited with a exiting roll 32 to an existing tray 33 provided in the upper part of the main body 1.

The recording paper 30 having a prescribed size is fed from a paper feeding tray 34 as a paper feeding device with a nudger roll 35, and a feeding roll 36*a* and retarding roll 36*b* for separating and conveying paper, and once conveyed to a resist roll 38 through a paper conveying path 37 having a conveying roll 37*a*, followed by being stopped, as shown in FIGS. 2 and 3. The conveying path 37 of the recording paper 30 thus fed is directed upward in the vertical direction. The recording paper 30 thus fed from the paper feeding tray 34 is then dispatched to the secondary transfer point of the intermediate transfer belt 25 with a the resist roll 38 rotating at a prescribed timing.

In the case where a full color double-sided print is to be obtained in the aforementioned digital color printer and duplicator, the recording paper 30 having an image fixed on one surface thereof is not directly discharged to the existing tray 33 with the existing roll 32 but is switched in conveying direction with a switching gate, which is not shown in the figures, and conveyed to a conveying unit 40 for double-sided print through a roller pair 39 for conveying paper. In the conveying unit 40 for double-sided print, the recording paper 30 is turned inside out with roller pairs 45 and 46 provided along a conveying path 41 and again conveyed to the resist roll 38. The recording paper 30 is then subjected to printing and fixing an image on the back surface thereof and discharged to the existing tray 33.

In FIG. 2, numerals 44Y, 44M, 44C and 44K denote toner cartridges for supplying toners of the respective colors of yellow (Y), magenta (M), cyan (C) and black (K) to the developing devices 17 of the prescribed colors.

Figure 4:
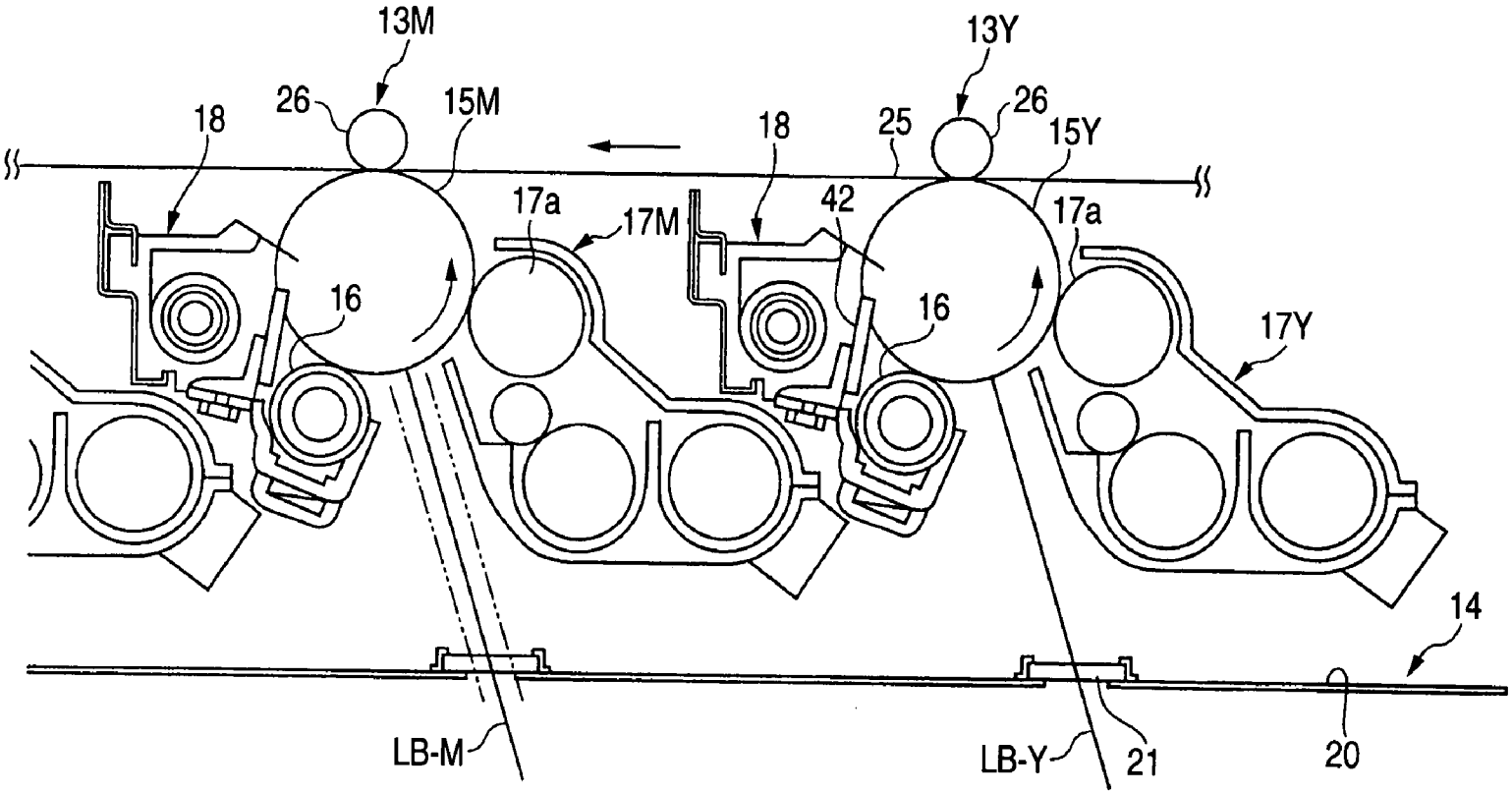
FIG. 4 is a constitutional view showing an image forming part of an image forming apparatus, to which a driving device for an image carrying member according to Embodiment 1 of the invention is applied.

FIG. 4 shows image forming units of the aforementioned digital color printer or duplicator.

The four image forming units 13Y, 13M, 13C and 13K of yellow, magenta, cyan and black colors have the same constitution as shown in FIG. 4, and the toner images of yellow, magenta, cyan and black colors are sequentially formed at a prescribed timing in the four image forming units 13Y, 13M, 13C and 13K. The image forming units 13Y, 13M, 13C and 13K each has the photoreceptor drum 15 as described in the foregoing, and the surface of the photoreceptor drum 15 is uniformly charged with the charging roll 16 for primary charge. Thereafter, the surface of the photoreceptor drum 15 is scan-exposed with the laser beam LB for image formation emitted from the ROS 14 corresponding to the image data, whereby electrostatic latent images corresponding to the respective colors are formed thereon. The laser beam LB for scan-exposure on the photoreceptor drums 15 is arranged to be incident on the photoreceptor drums 15 from a diagonally lower direction slightly right from directly under the photoreceptor drums 15. The electrostatic latent images thus formed on the photoreceptor drums 15 are developed with toners of the respective colors of yellow, magenta, cyan and black by a developing roll 17*a* of the developing devices 17 of the image forming units 13Y, 13M, 13C and 13K to form visible toner images, and the visible toner images are sequentially transferred by overlapping each other on the intermediate transfer belt 25 with the charge of the primary transfer roll 26.

The surface of the photoreceptor drum 15 after completing the transferring step of the toner image is cleaned by removing the remaining toner and paper dusts with the cleaning device 18 to prepare the next image forming process. The cleaning device 18 is equipped with a cleaning blade 42, and the remaining toner and paper dusts on the surface of the photoreceptor drum 15 are removed with the cleaning blade 42. The surface of the intermediate transfer belt 25 after completing the transferring step of the toner image is cleaned by removing the remaining toner and paper dusts with a cleaning device 43 to prepare the next image forming process, as shown in FIG. 2. The cleaning device 43 is equipped with a cleaning brush 43*a* and a cleaning blade 43*b*, and the remaining toner and paper dusts on the surface of the intermediate transfer belt 25 are removed with the cleaning brush 43*a* and the cleaning blade 43*b*.

The main body 1 of the printer shown in FIG. 2 has a multi sheet feed tray 47 on the left side thereof, and the multi sheet feed tray 47 is rotated anticlockwise to a substantially horizontal position, followed by terminating, whereby a transfer medium different in material and size, such as an OHP sheet and a postcard, can be fed from the multi sheet feed tray 47.

According to this embodiment, in a driving device for an image carrying member for rotating the image carrying member by transmitting a rotation driving force of a driving power source to the image carrying member, a rotating member rotates in contact with at least one of a driving force transmitting member and the image carrying member, which are arranged in the driving force transmission path for transmitting the driving force to the image carrying member, and the rotating member provides, upon occurring fluctuation in velocity of the driving force transmitting member or the image carrying member, a viscous effect that suppresses the fluctuation in velocity.

In this embodiment, the rotating member providing the viscous effect may be formed with a rotating member that is rotationally driven at the substantially same velocity as the driving force transmitting member or the image carrying member.

In this embodiment, furthermore, the rotating member providing the viscous effect may be formed with a rotating member that is rotationally driven at a velocity with a difference in peripheral velocity of 1% or less from the driving force transmitting member or the image carrying member.

Figure 1:
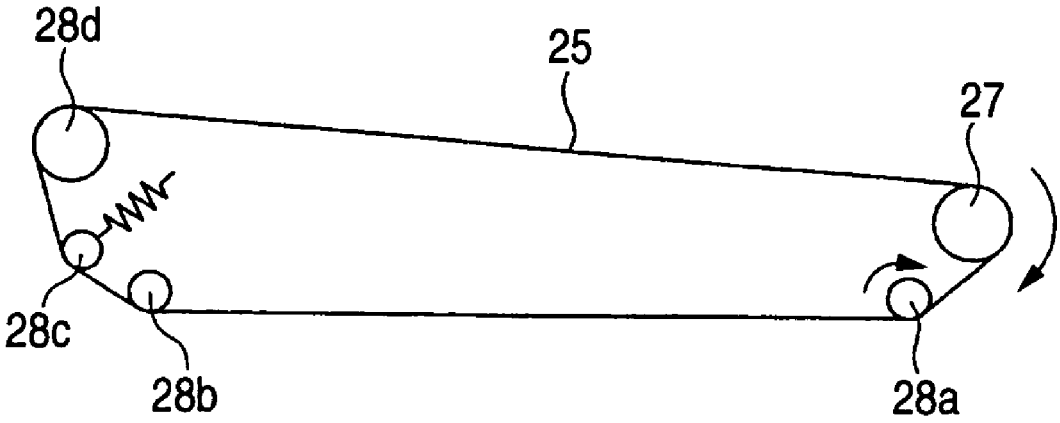
FIG. 1 is a constitutional view showing an important part of an image forming apparatus, to which a driving device for an image carrying member according to Embodiment 1 of the invention is applied.

In this embodiment, accordingly, as shown in FIG. 1, among the plural rolls stretching the intermediate transfer belt 25, a damper roll 28*a* providing the viscous effect is provided as such a rotating member that also functions as a primary transfer surfacing roll positioned in the vicinity of the driving roll 27 on the downstream of the moving direction of the intermediate transfer belt 25 with respect to the driving roll 27 and on the upstream of the load system. The damper roll 28*a* is a roll that is driven separately from the driving roll 27 and is in contact with an inner surface of the intermediate transfer belt 25 as the image carrying member.

The damper roll 28*a* is configured to be rotationally driven in the same rotating direction as the driving roll 27 at the substantially same average velocity as the surface velocity of the driving roll 27. The term "the substantially same average velocity" herein means an average velocity differential of 1% or less from the surface velocity of the driving roll 27. In this embodiment, the damper roll 28*a* is rotationally driven at the substantially same average velocity as the surface velocity of the driving roll 27.

Figure 6:
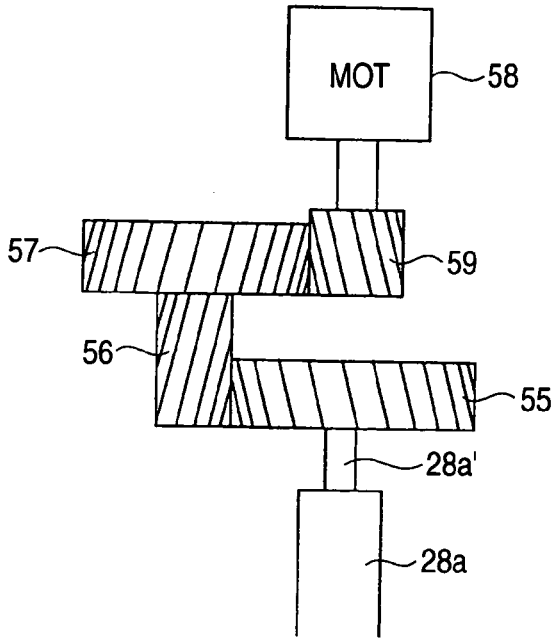
FIG. 6 is an explanatory view showing a driving system for a damper roll.

A driven gear 55 is attached to a pivot 28*a*' of the damper roll 28*a* as shown in FIG. 6, and the driven gear 55 is engaged with a small idler gear 56 among reduction idler gears. A large idler gear 57 among the reduction idler gears is engaged with a driving gear 59 attached to a driving motor 58 as the driving power source containing a stepping motor, a DC induction motor or the like. The damper roll 28*a* is rotationally driven at the substantially same average velocity as the surface velocity of the driving roll 27 by rotationally driving the driving motor 58 through the driving gear 59, the idler gears 56 and 57, and the driven gear 55.

While the damper roll 28*a* and the driving roll 27 are driven with the different driving power sources in this embodiment, it may be constituted in such a manner that the damper roll 28*a* and the driving roll 27 are driven with the same driving power source.

According to the aforementioned constitution, the damper roll 28*a* stretches the intermediate transfer belt 25 and is in direct contact with the inner surface of the intermediate transfer belt 25, whereby even in the case where fluctuation in velocity occurs in the intermediate transfer belt 25 as the image carrying member, the damper roll 28*a* is to be rotated at a constant velocity to provide the viscous effect that suppresses the fluctuation in velocity of the intermediate transfer belt 25. In other words, it provides a dashpot viscous effect of a vibration model containing a spring, a dashpot (damper) and an inertial mass.

More specifically, in the case where fluctuation in velocity $\Delta V$ occurs in the intermediate transfer belt 25, because the damper roll 28*a* is to be rotated at a constant velocity, a force F that causes a viscous effect suppressing the fluctuation in velocity $\Delta V$ is applied to the intermediate transfer belt 25.

The force F causing a viscous effect herein can be expressed by the equation, $F=\eta dV/dt$, and the coefficient $\eta$ is a parameter corresponding to the viscous effect exerted by the damper roll 28*a*. The viscous effect exerted by the damper roll 28*a* is determined by the inertial mass of the damper roll 28*a*, the driving force for driving the damper roll 28*a*, and the like.

According to the aforementioned constitution, the driving device for an image carrying member in this embodiment causes no increase in size and cost of the device and sufficiently stabilizes the velocity of the image carrying member, such as the belt, upon fluctuation in load, so as to suppress or prevent formation of an image defect referred to as so-called "banding", in the following manner.

That is, in this embodiment, as shown in FIGS. 2 to 4, the intermediate transfer belt 25 is rotated at a prescribed velocity with the driving roll 27, and the toner images of the respective colors of yellow (Y), magenta (M), cyan (C) and black (K) having been sequentially formed on the photoreceptor drums 15 of the image forming units 13Y, 13M, 13C and 13K of yellow (Y), magenta (M), cyan (C) and black (K) colors are transferred by overlapping each other on the intermediate transfer belt 25 to form a color image.

At this time, in the supporting and driving system for supporting and driving the intermediate transfer belt 25, the backup roll 28*d*, the tension roll 28*c* and the primary transfer surfacing roll 28*b* function as the inertial mass, and the backup roll 28*d*, the tension roll 28*c* and the like have torsional rigidity. Furthermore, the backup roll 28*d*, the tension roll 28*c* and the primary transfer surfacing roll 28*b* are connected to the driving roll 27 through the intermediate transfer belt 25 mainly functioning as a viscoelastic body, so as to constitute a supporting and driving system.

In this embodiment, as shown in FIG. 1, among the plural rolls supporting the intermediate transfer belt 25, the damper roll 28*a* causing a viscous effect is provided as such a rotating member that also functions as a primary transfer surfacing roll positioned in the vicinity of the driving roll 27 on the downstream of the moving direction of the intermediate transfer belt 13 with respect to the driving roll 27 and on the upstream of the load system. The damper roll 28*a* is configured as being driven in the same direction as the driving roll 27 at the substantially same average velocity as the surface velocity of the driving roll 27.

According to the configuration, in the case where fluctuation in velocity occurs in the intermediate transfer belt 25 due to various factors, the damper roll 28*a* applies the viscous effect suppressing the fluctuation in velocity of the intermediate transfer belt 25 to the intermediate transfer belt 25. As a result, the resonance point of the intermediate transfer belt 25 itself and the supporting and driving system containing the backup roll 28*d*, the tension roll 28*c* and the primary transfer surfacing roll 28*b* in the supporting and driving system can be attenuated to a large extent, and even in the case where fluctuation in load occurs, the damper roll 28*a* applies the viscous effect to stabilize sufficiently the driving velocity of the intermediate transfer belt 25 without magnifying the fluctuation in load, whereby formation of an image defect referred to as so-called "banding" can be suppressed or prevented. The damper roll 28*a* may be provided as a roll for supporting the intermediate transfer belt 25, and therefore, it causes no increase in size and cost of the device.

Experimental Example 1

In order to confirm the effect of the invention, the inventors have measured fluctuation in velocity of the driving roll 27 for rotationally driving the intermediate transfer belt 25 in the color image forming apparatus shown in FIGS. 1 and 2, and also have measured the transfer function characteristics of the driving system from the driving motor 53 to the driving roll 27 as shown in FIG. 5.

Figure 7:
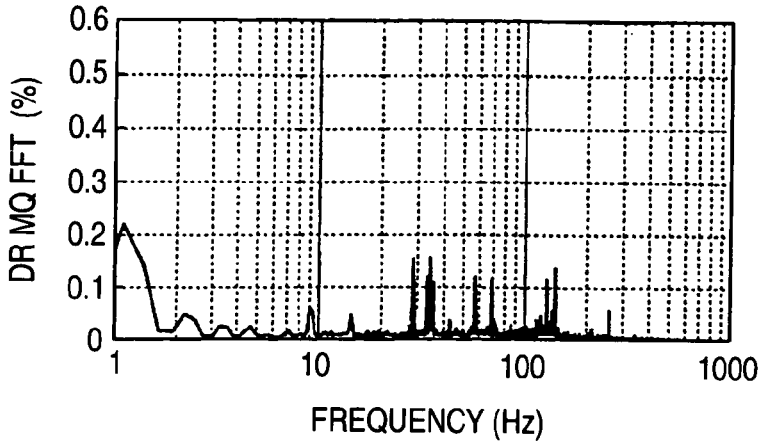
FIG. 7 is a graph showing experimental results.
Figure 8:
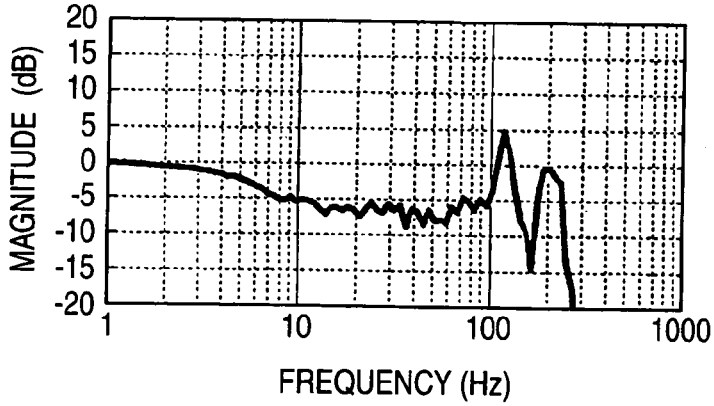
FIG. 8 is a graph showing experimental results.

FIGS. 7 and 8 are graphs showing the results of the aforementioned measurements. The ordinate in FIG. 7 indicates the value obtained by FFT analysis of the fluctuation in rotation velocity of the driving roll 27. The ordinate in FIG. 8 indicates the value showing a magnitude of the transfer function.

It is understood from FIGS. 7 and 8 that the decay area appears in a large range of from 3 to 100 Hz on the transfer function characteristics of the driving system, and the peaks having significantly appeared as fluctuation in velocity are disappeared to provide rotational driving of the intermediate transfer belt 25 at an extremely stable velocity. Accordingly, formation of an image defect referred to as so-called "banding" can be certainly suppressed or prevented.

Experimental Example 2

The inventors have conducted such an experiment using the color image forming apparatus shown in FIGS. 1 and 2 in that the change of the dynamic load torque of the driving roll is observed in the case where the rotation velocity of the damper roll 28*a* is changed.

Figure 9:
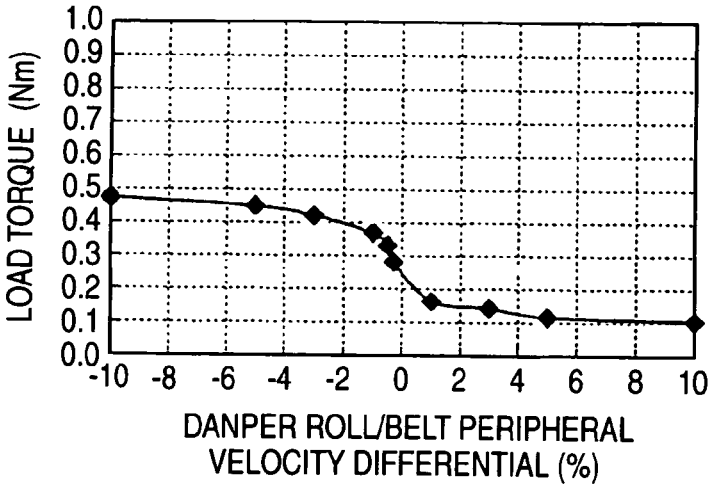
FIG. 9 is a graph showing experimental results.

FIG. 9 is a graph showing the results of the experiment.

It is understood from FIG. 9 that the load torque of the driving roll 27 has such characteristics that it increases in the case where the peripheral velocity differential between the damper roll 28*a* and the intermediate transfer belt 25 is negative (i.e., the damper roll 28*a* has a negative velocity) and decreases in the case where the peripheral velocity differential is positive (i.e., the damper roll 28*a* has a positive velocity), with the point of zero peripheral velocity differential, where the velocity of the damper roll 28*a* agrees with the velocity of the intermediate transfer belt 25, as the inflection point. The change in load torque with respect to the change in velocity in the vicinity of the inflection point exerts the viscous effect to attenuate the resonance point at 50 Hz on the transfer function characteristics of the belt supporting and driving system. It is also understood from FIG. 9 that in the case where the peripheral velocity differential between the damper roll 28*a* and the intermediate transfer belt is ±1%, the fluctuation in load torque of the driving roll 27 with respect to the peripheral velocity differential is large, i.e., the viscous effect suppressing fluctuation in velocity of the belt driven by the driving roll 27 can be sufficiently obtained.

As described in the foregoing, the damper roll 28*a* driven at the substantially same surface velocity as the driving roll 27 is made in contact with the intermediate transfer belt 25 in addition to the driving roll 27 of the belt supporting and driving system, whereby the resonance of the intermediate transfer belt 25 can be suppressed without occurrence of secondary defects, such as a large sized device due to the addition of a flywheel and an influence of torque fluctuation due to an elastic member, and thus the intermediate transfer belt 25 can be driven at a stable velocity.

Embodiment 2

Figure 10:
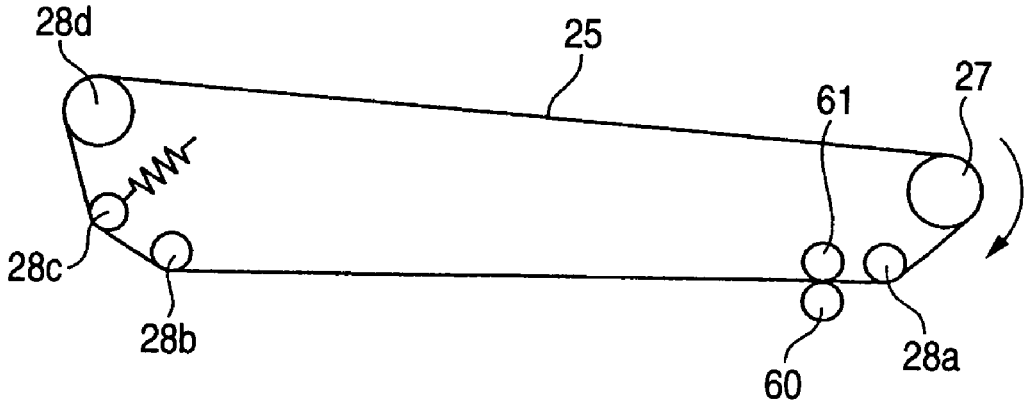
FIG. 10 is a constitutional view showing an important part of an image forming apparatus, to which a driving device for an image carrying member according to Embodiment 2 of the invention is applied.

FIG. 10 shows Embodiment 2 according to the invention, in which the same members as in the Embodiment 1 are attached with the same symbols. In the Embodiment 2, the rotating member providing the viscous effect is made in contact with the outer surface of the belt member.

In the Embodiment 2, the rotating member providing the viscous effect is arranged at a position opposite to a pressing member with respect to the belt member.

That is, in the Embodiment 2 shown in FIG. 10, among the plural rolls supporting the intermediate transfer belt 25, a damper roll 60 causing a viscous effect is provided, in contact with the outer surface of the intermediate transfer belt 25, in the vicinity of the driving roll 27 on the downstream of the primary transfer surfacing roll 28*a* positioned on the downstream of the driving roll 27. A pressing roll 61 as a pressing member is rotatably provided at a position opposite to the damper roll 60 with respect to the intermediate transfer belt 25 to hold the intermediate transfer belt 25 therebetween.

According to the configuration, the attenuation effect can be enhanced by making the pressing roll 61 opposite to the damper roll 60 in contact therewith to hold the intermediate transfer belt 25 therebetween.

The damper roll 60 is used as the rotating member providing the viscous effect in this embodiment, and the attenuation effect of the damper roll 60 can be improved by providing a coating formed, for example, with rubber, which controls the friction coefficient of the surface of the damper roll 60, so as to control the attenuation characteristics.

The inventors have provided a damper roll at all the positions on the belt supporting rolls for supporting the intermediate transfer belt 25 to confirm the effect. It has been found been found therefrom that the attenuation effect can be obtained most efficiently in the case where the damper roll is provided at a position downstream with respect to the driving roll and upstream of the load system. It is preferred that the damper roll is provided at that position in the case where no restriction occurs in the constitution of the image forming apparatus.

More specifically, as shown in FIG. 11, in the supporting and driving system of the intermediate transfer belt 25, simultaneous equations are set up with the rotation angles θ of the rolls supporting the intermediate transfer belt 25 as variables, and the state of the transfer function characteristics of the supporting and driving system of the intermediate transfer belt 25 is observed by simulation.

Figure 12:
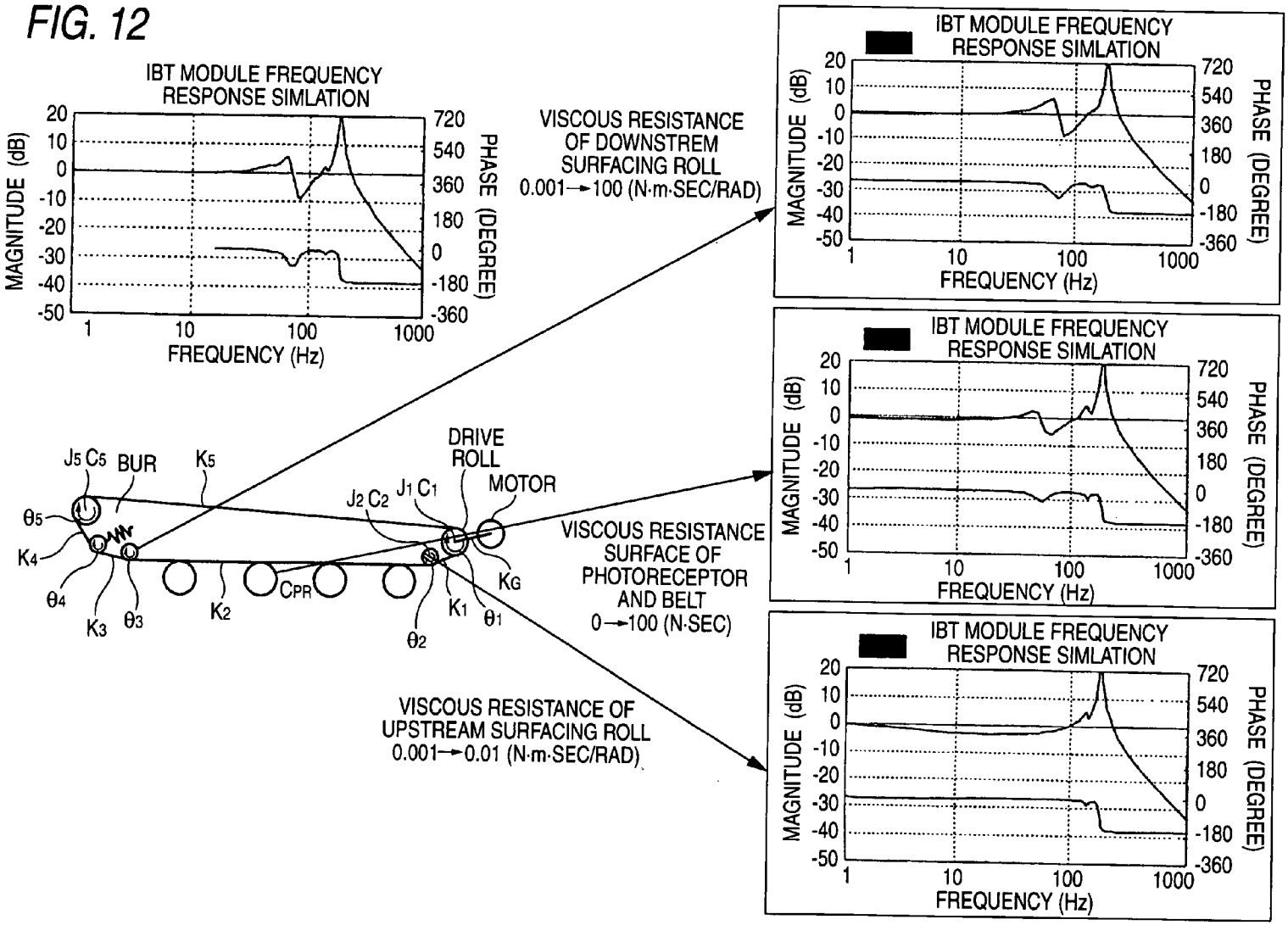
FIG. 12 is a graph showing simulation results.

FIG. 11 shows the results of the transfer function characteristics of the supporting and driving system of the intermediate transfer belt 25 obtained by experiment, and FIG. 12 shows the results of the transfer function characteristics of the supporting and driving system of the intermediate transfer belt 25 obtained by simulation.

It is understood from the results obtained by simulation that the transfer function characteristics in the region of 100 Hz or lower are well reproduced.

The results obtained by applying the simulation to the cases where the position of the damper roll is changed are shown in FIG. 12.

It is understood from FIG. 12 that in the cases where the damper roll is provided at the positions of the primary transfer surfacing roll 28*a* and the photoreceptor drum 15, a magnifying area appears in a region of 100 Hz or lower in the transfer function characteristics, but in the case where the damper roll is provided at a position on the downstream with respect to the driving roll 27 and on the upstream of the load system, no magnifying area appears in a region of 100 Hz or lower in the transfer function characteristics, whereby the attenuation effect can be obtained in the most efficient manner.

While the damper roll driven at the substantially same velocity as the belt is made in contact with the belt to obtain the viscous effect in this embodiment, it may also be constituted in such a manner that the viscous damper is operated by connecting to the driving roll.

The other constitution and effects of this embodiment are the same as those in the aforementioned embodiment, and the descriptions therefor are omitted herein.

Embodiment 3

Figure 13:
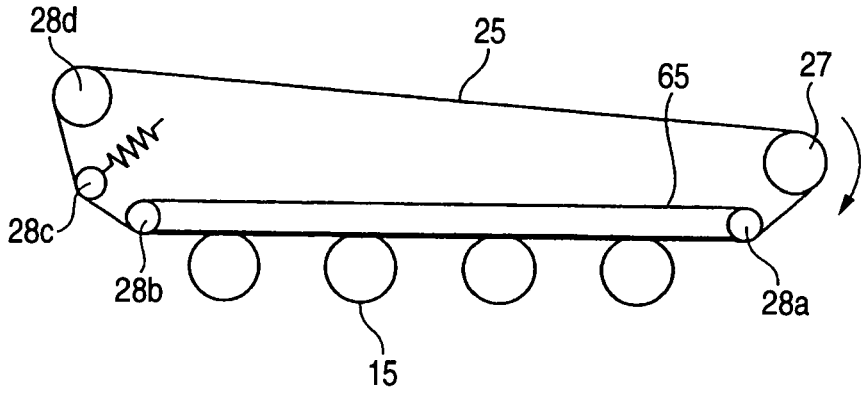
FIG. 13 is a constitutional view showing an important part of an image forming apparatus, to which a driving device for an image carrying member according to Embodiment 3 of the invention is applied.

FIG. 13 shows Embodiment 3 according to the invention, in which the same members as in the aforementioned embodiments are attached with the same symbols. In the Embodiment 3, image carrying members providing the viscous effect are made in contact with the photoreceptor drums 25 in addition to the intermediate transfer belt 25.

In the Embodiment 3, a belt member 25 that is cyclically driven at the substantially same velocity as the photoreceptor drums is made in contact with the photoreceptor drums 25.

That is, in the Embodiment 3 shown in FIG. 13, a damper roll 28*a* that also functions as a primary transfer surfacing roll is provided at a position downstream of the driving roll 27, and a damper belt 65 as a rotating member for suppressing fluctuation in rotation velocity of the photoreceptor drums 15 is stretched between one end of the damper roll 28*a* and one end of the primary transfer surfacing roll 28*b*.

In the Embodiment 3, fluctuation in rotation velocity of the intermediate transfer belt 25 is suppressed, and furthermore, fluctuation in rotation velocity of the photoreceptor drums 15 is also suppressed.

In order to improve the transfer efficiency of the toner images from the photoreceptor drums 15 to the intermediate transfer belt 25 in the Embodiment 3, the peripheral velocity differential between the photoreceptor drums 15 and the intermediate transfer belt 25 is set at 3% (wherein the velocity of the intermediate transfer belt 25 is larger). Furthermore, the damper roll 28*a* is provided to suppress fluctuation in velocity of the intermediate transfer belt 25 as similar to the Embodiment 1, and the damper roll 28*a* is driven at the substantially same velocity as the driving roll 27 and is in contact with the inner surface of the intermediate transfer belt 25.

Figure 14:
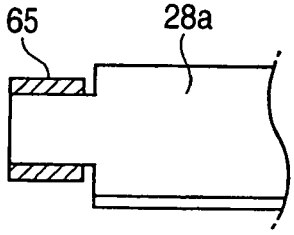
FIG. 14 is a constitutional view showing a damper roll.

The end of the damper roll 28*a* has a stepped shape as shown in FIG. 14, at which the diameter is smaller by 3%. The end of the primary transfer surfacing roll 28*b* has the same shape, and the damper belt 65 for the photoreceptor drum 15 is wound on the parts having the smaller diameter of the damper roll 28*a* and the primary transfer surfacing roll 28*b*. The damper belt 65 is made in contact with ends on the surfaces of the four photoreceptor drums 15.

According to the configuration, the transfer function of the intermediate transfer belt 25 is attenuated with the damper roll 28*a* to suppress fluctuation in velocity, and the transfer functions of the four photoreceptor drums 15 are also attenuated with the damper belt 65 to suppress fluctuation in velocity.

The other constitution and effects of this embodiment are the same as those in the aforementioned embodiments, and the descriptions therefor are omitted herein.

Embodiment 4

Figure 15:
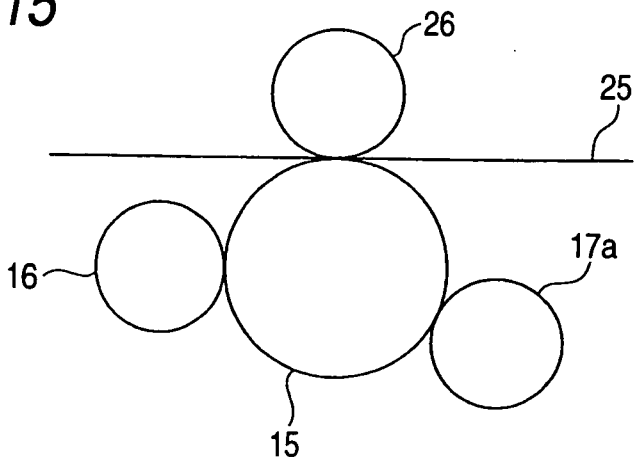
FIG. 15 is a constitutional view showing an important part of an image forming apparatus, to which a driving device for an image carrying member according to Embodiment 4 of the invention is applied.

FIG. 15 shows Embodiment 4 according to the invention, in which the same members as in the aforementioned embodiments are attached with the same symbols. In the Embodiment 4, the image carrying member is constituted with a photoreceptor drum 15, and a rotating member 16 rotationally driven at the same velocity as the photoreceptor drum 15 is made in contact with the photoreceptor drum 15.

In this embodiment, the rotating member also functions as a member 16 for forming an image on the photoreceptor drum 15.

That is, in the Embodiment 4 shown in FIG. 15, the surface of a photoreceptor drum 15, to which a driving force is transmitted from a driving power source, is made in contact with a damper roll 16 that is rotationally driven at the substantially same velocity as the photoreceptor drum 15 with a different driving power source or the same driving power source. The damper roll 16 also functions as a charging roll as an image forming member contributing image formation for charging the surface of the photoreceptor drum 15.

The surface of the photoreceptor drum 15 is made in contact with the damper roll 16, whereby fluctuation in rotation of the photoreceptor drum 15 can be suppressed.

Figure 16:
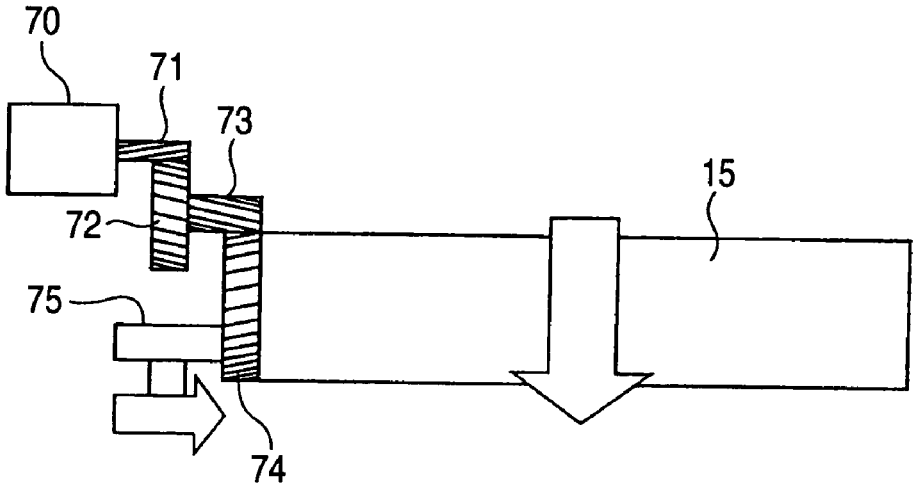
FIG. 16 is a constitutional view showing a modified embodiment of an image forming apparatus, to which a driving device for an image carrying member according to Embodiment 4 of the invention is applied.
Figure 17:
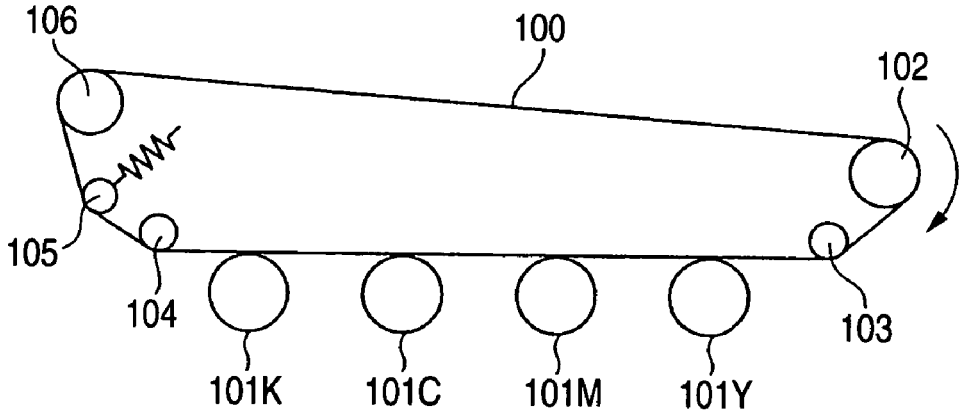
FIG. 17 is a constitutional view showing an image forming apparatus, to which a conventional driving device for an image carrying member is applied.
Figure 18:
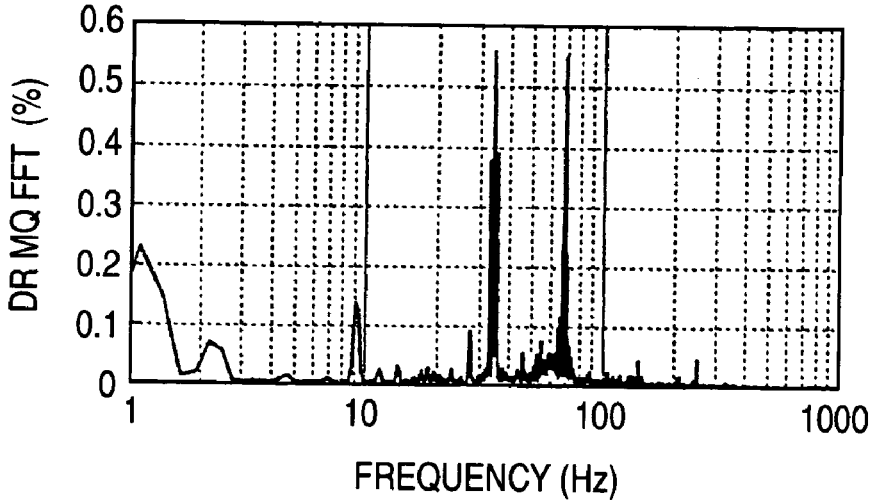
FIG. 18 is a graph showing experimental results of a conventional driving device.
Figure 19:
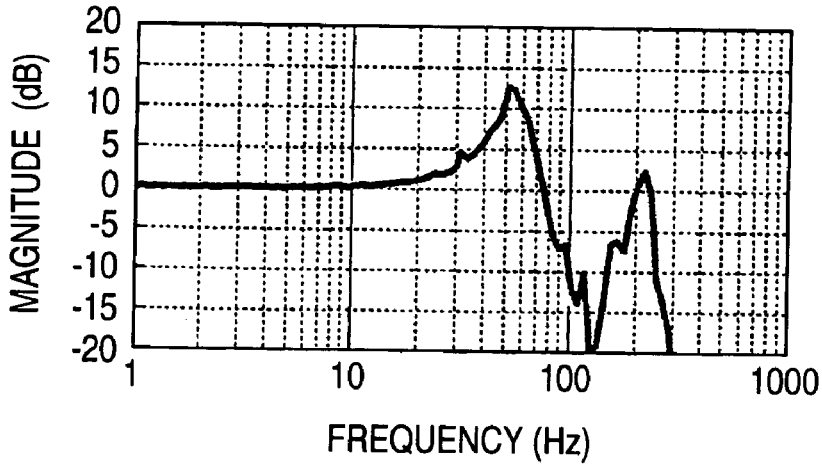
FIG. 19 is a graph showing experimental results of a conventional driving device.

As another constitution where fluctuation in rotation of the photoreceptor drum 15 is suppressed, such a constitution as shown in FIG. 16 may be employed in that a side surface of a driving gear 74 (photoreceptor drum gear) in the driving force transmission path for driving the photoreceptor drum 15 from a driving motor 70 to gears 71 to 74 is made in contact with a damper member 75 formed, for example, with a rubber roller, that is driven with a separate driving power source at the substantially same velocity.

The other constitution and effects of this embodiment are the same as those in the aforementioned embodiments, and the descriptions therefor are omitted herein.

While the invention has been described with reference to the aforementioned embodiments, the invention is not construed as being limited thereto, and various changes can be made therein unless the spirits of the invention are impaired. For example, the image carrying member is not limited to an intermediate transfer belt or a photoreceptor, but a transporting transfer belt and a fixing belt may be applied. The member for applying the viscous resistance is not limited to a damper roll or the like, but any member that can apply the viscous effect can be employed. While the viscous effect is controlled with the driving force for driving the damper roll providing the viscous effect, it may also be controlled with an inertial mass of the damper roll itself, the frictional force among the members (i.e., the product of the frictional coefficient and the vertical force), the driving velocity of the damper roll (i.e., change in dynamic frictional coefficient), or other factors.

As described in detail with reference to the aforementioned embodiments, the apparatuses of the embodiments cause no increase in size and cost of the device, can sufficiently stabilize the velocity of the image carrying member, such as a belt and formation of an image defect referred to as so-called "banding" can be suppressed or prevented upon occurrence of fluctuation in load.

Furthermore, a rotating member is made in contact with at least one of a driving force transmitting member and an image carrying member, which are arranged in a driving force transmission path for transmitting the driving force to the image carrying member, and the rotating member rotating in contact with the driving force transmitting member or the image carrying member provides, upon occurring fluctuation in velocity of the driving force transmitting member or the image carrying member, a viscous effect that suppresses the fluctuation in velocity, whereby in the case where fluctuation in velocity occurs in the driving force transmitting member or the image carrying member, the viscous effect suppressing the fluctuation in velocity is applied by the rotating member rotating in contact with the driving force transmitting member or the image carrying member to suppress the fluctuation in viscosity of the driving force transmitting member or the image carrying member. Accordingly, the invention can sufficiently stabilize the velocity of the image carrying member and can suppress or prevent formation of an image defect referred to as so-called "banding".

Moreover, no increase in size and cost of the device is caused owing to the absence of a flywheel or the like. Because the rotating member provides the viscous effect on fluctuation in velocity but does not have an elastic function or a viscoelastic function, no adverse affect due to an elastic function is caused even in the case where fluctuation in load occurs.

The load of the driving system for rotating the image carrying member can be prevented from being increased by rotating the rotating member at the substantially same velocity as the image carrying member.

The entire disclosure of Japanese Patent Application No. 2003-078954 filed on Mar. 20, 2003 including specification, claims, drawings and abstract is incorporated herein by reference in its entirety.

What is claimed is:

1. A driving device for an image carrying member for rotationally driving the image carrying member by transmitting a rotational driving force of a driving power source to the image carrying member comprising:

at least one driving force transmitting member arranged in a driving force transmission path for transmitting the driving force to the image carrying member; and a rotating member for rotating in contact with one of the driving force transmitting member and the image carrying member, and providing, upon occurring fluctuation in velocity of one of the driving force transmitting member and the image carrying member, a viscous effect that suppresses the fluctuation in velocity.

2. A driving device as claimed in claim 1, wherein the rotating member providing the viscous effect comprises a rotating member rotationally driven at the substantially same velocity as the driving force transmitting member or the image carrying member.

3. A driving device as claimed in claim 2, wherein the rotating member is rotationally driven with the same driving power source as that driving the image carrying member.

4. A driving device as claimed in claim 2, wherein the rotating member is rotationally driven with a different driving power source from that driving the image carrying member.

5. A driving device as claimed in claim 2, wherein the rotating member providing the viscous effect is rotationally driven at a velocity with a difference in peripheral velocity of 1% or less from the driving force transmitting member or the image carrying member.

6. A driving device as claimed in claim 1, wherein the rotating member providing the viscous effect is driven by the driving force transmitting member or the image carrying member and comprises a driven roll with a viscous damper operated by connecting thereto.

7. A driving device as claimed in claim 1, wherein the image carrying member comprises an endless belt member.

8. A driving device as claimed in claim 7, wherein the rotating member providing the viscous effect is made in contact with an inner surface of the belt member.

9. A driving device as claimed in claim 7, wherein the rotating member providing the viscous effect is made in contact with an outer surface of the belt member.

10. A driving device as claimed in claim 7, wherein the rotating member providing the viscous effect is provided with a pressing member at a position opposite thereto with respect to the belt member.

11. A driving device as claimed in claim 7, wherein the rotating member providing the viscous effect is positioned in vicinity of a driving roll for driving the belt member.

12. A driving device as claimed in claim 11, wherein the rotating member providing the viscous effect is positioned downstream of the driving roll for driving the belt member and upstream of a load system.

13. A driving device as claimed in claim 1, wherein the image carrying member comprises a photoreceptor drum.

14. A driving device as claimed in claim 13, wherein the photoreceptor drum is made to contact a rotating member rotationally driven at substantially the same velocity as the photoreceptor drum, and the rotating member also functions a charging roll, a developing roll or a cleaning roll.

15. A driving device as claimed in claim 13, wherein the photoreceptor drum is made to contact with a belt member cyclically driven at substantially the same velocity as the photoreceptor drum.

16. A driving device as claimed in claim 13, wherein the driving force transmitting member for transmitting a driving force from a driving power source to the photoreceptor drum is made to contact with a rotating member rotationally driven at substantially the same velocity as the photoreceptor drum.

17. An image forming apparatus comprising:

an endless member supporting system comprising an endless member for carrying an image or a medium having an image formed thereon; and a vibration model comprising a driving system comprising a driving unit for rotating the endless member;

the endless member supporting system having a resonance point in the range outside of from 10 to 100 Hz.

18. An image forming apparatus comprising:

an endless member for carrying an image or a medium having an image formed thereon;

a first driving unit for rotating the endless member; and a second driving unit connected to the endless member and applying a driving force with substantially the same rotation number as the first driving unit.

19. An image forming apparatus as claimed in claim 18, wherein the first driving unit and the second driving unit receive a driving force from the same motor.

* * * * *